United States Patent [19]

Carpenter et al.

[11] Patent Number: 4,509,300

[45] Date of Patent: Apr. 9, 1985

[54] VANE RETENTION APPARATUS FOR ABRASIVE BLASTING MACHINE

[75] Inventors: James H. Carpenter; Donald G. Corderman, both of Hagerstown, Md.

[73] Assignee: Kennecott Corporation, Cleveland, Ohio

[21] Appl. No.: 359,411

[22] Filed: Mar. 18, 1982

Related U.S. Application Data

[63] Continuation-in-part of Ser. No. 245,028, Mar. 18, 1981, Pat. No. 4,402,163.

[51] Int. Cl.[3] ..... B24C 5/06

[52] U.S. Cl. ..... 51/435

[58] Field of Search ..... 51/435, 434, 431, 432; 241/275

[56] References Cited

U.S. PATENT DOCUMENTS

| | | | |
|---|---|---|---|
| 2,119,812 | 6/1938 | Hamren | 51/434 |
| 2,119,813 | 6/1938 | Keefer | 51/434 |
| 2,869,289 | 1/1959 | Gossard | 51/434 |
| 3,241,266 | 3/1966 | Bowling, Jr. | 51/435 |
| 3,383,804 | 5/1968 | Haider | 51/434 |
| 3,872,624 | 3/1975 | Ramaswamy | 51/435 |
| 3,945,150 | 3/1976 | Beckner | 51/434 |

*Primary Examiner*—Frederick R. Schmidt
*Assistant Examiner*—Robert A. Rose
*Attorney, Agent, or Firm*—R. Lawrence Sahr; Burtsell J. Kearns

[57] ABSTRACT

This invention relates to the mounting of vanes on a runnerhead of an abrasive blasting machine. The face of the runnerhead is provided with slots in which bases of vanes are slid in a generally radial direction with the base having an interlock with the runnerhead so as to retain the vane against movement normal to the face of the runnerhead. This invention particularly has to do with the locking of the vane base in the runnerhead slot. A locking pin is used which is preferably rectangular as opposed to the usual circular pin and the outer ends of the runnerhead slot and vane base are provided with cooperating slots and grooves which receive the pin, the pin being inserted in a first groove and slot arrangement at an angle to the axis of the base and then rotated or pivoted into a second groove and slot arrangement where it is locked in place against retrieval. The pin is locked in place by the outwardly movement of the vane from its pin inserting position. Certain embodiments of the invention have a safety feature in when the vane is in the pin receiving position, the inner end of the vane will engage a lug case on the outside of the impeller case so as to prevent rotation of the runnerhead.

13 Claims, 23 Drawing Figures

VANE RETENTION APPARATUS FOR ABRASIVE BLASTING MACHINE

BACKGROUND OF THE INVENTION

This application is a continuation-in-part of copending application Ser. No. 245,028, filed Mar. 18, 1981 now U.S. Pat. No. 4,402,163.

This invention relates in general to new and useful improvements in abrasive blasting machines of the type including a runnerhead having an exposed face provided with a plurality of generally radiating vanes. This invention constitutes an improvement with respect to U.S. Pat. No. 3,872,624 and like blasting machines.

In some earlier blasting machine wheel constructions, it is possible to remove a vane without removing the feed parts, i.e. feed spout, impeller, impeller case and deflector. This is possible because the pin attachment for retaining a vane on the runnerhead is restricted to one pin installed perpendicularly to the runnerhead on the back side of the vane. Removal of this pin can be accomplished without vane movement. After the pin is removed, the vane can then be pulled radially out of the runnerhead.

In other constructions, double runnerheads are provided and the vanes slide into slots in the double runnerheads from the center of the wheel and are held in place by a spacer bar which extends between and supports the runnerheads. This arrangement requires removal of all feed parts as well as removal of the vanes out through the feed spout opening.

In yet other arrangements, which are less popular, the vanes are bolted to the runnerhead. Another method of securing vanes to the runnerhead is that disclosed in the above-mentioned U.S. Pat. No. 3,872,624. In this arrangement, the retaining pin is moved from the back of the vane to the bottom outer edge of the vane base. In this position, the pin tends to hold the vane perpendicularly in the runnerhead slot. This is advantageous because a tilting force acts on the vane. The force is created because the vane sits at an angle off of a radial line from the center of rotation of the runnerhead. While this design is fail safe and holds the vane perpendicular, it requires (1) removal of fed parts, (2) movement of the vane forward to release the pin, and (3) pin removal in order to remove the vane.

SUMMARY OF THE INVENTION

In accordance with this invention, an improved vane retention apparatus is provided which provides for ready removal of vanes and eliminates the need for removal of feed parts, impeller, case and the like during vane replacement. According to one aspect of this invention, a throwing vane is provided with a recess at the outer end of the base of the vane. This recess is made up of an axial pin retaining groove and an angled pin insertion groove which intersects the pin retaining groove. As will be explained in detail below, the pin insertion groove allows ready insertion and removal of locking pins with a minimum of movement of the vane with respect to the runnerhead. In this way vane replacement is simplified.

In the preferred embodiments of this invention, a retangular locking pin is utilized instead of the usual round pin, giving additional aid in holding a vane perpendicular to the runnerhead. In addition, the rectangular pin places the pin pull-out hole always in the same position for easy insertion for a pin puller hook as opposed to the possibility that the pull-out hole may be in any position with a round pin. The use of a rectangular pin, for a given size pin recess, gives a larger shear area for retaining the vane and thus a greater safety factor. In addition, the pin recess in the runnerhead is simpler to machine.

Yet another feature of the invention is the provision of lugs on the impeller case which force the vane assembler to lock the pin in place before one can rotate the wheel to the next vane insertion position.

With the above, and other objects in view that will hereinafter appear, the nature of the invention will be more clearly understood by reference to the following detailed description, the appended claims and the several views illustrated in the accompanying drawings.

BRIEF DESCRIPTIONS OF THE DRAWINGS

DETAILED DESCRIPTION OF THE PRESENTLY PREFERRED EMBODIMENTS

Figure 1:
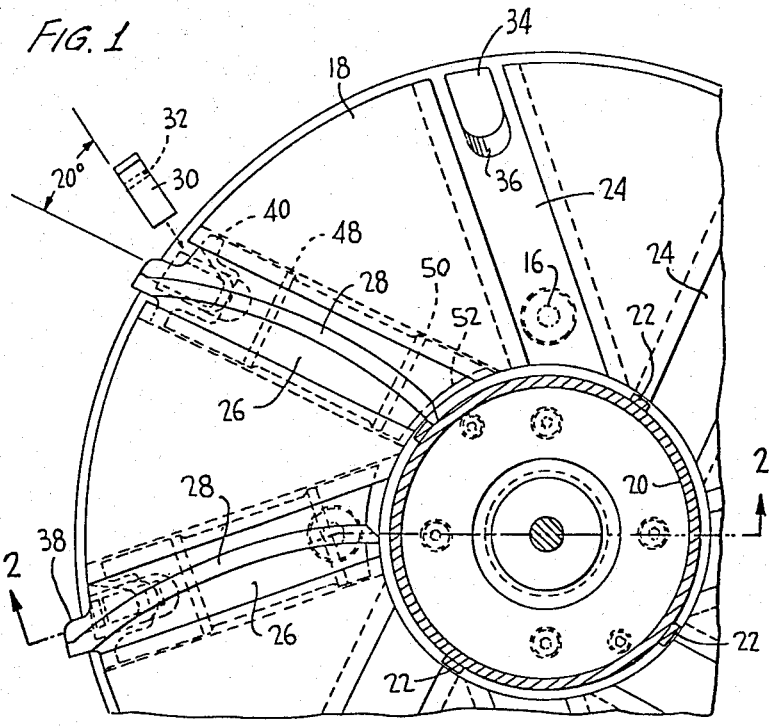
FIG. 1 is a fragmentary sectional view through an abrasive blasting machine with the runnerhead being shown in elevation and one vane in place and a second vane being positioned, the view being taken generally along the line 1—1 of FIG. 2.
Figure 2:
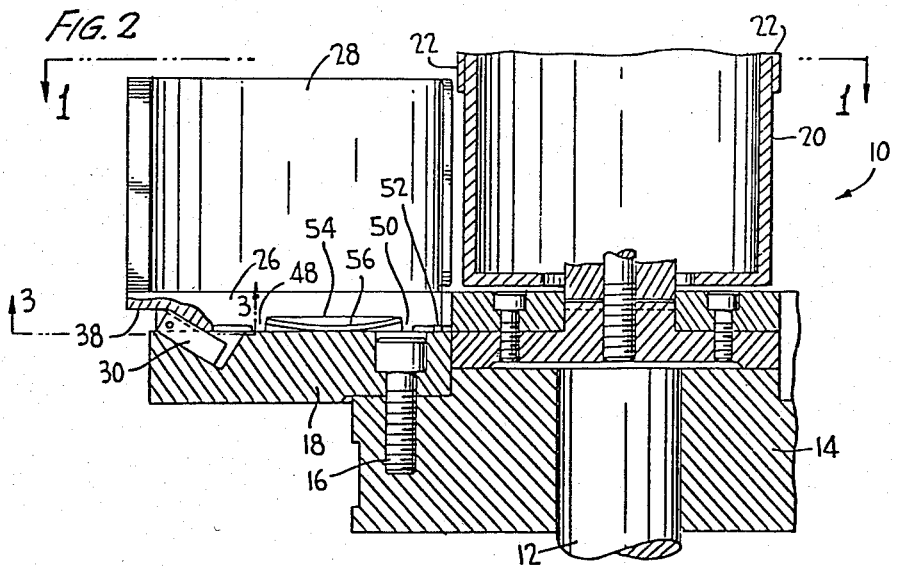
FIG. 2 is a transverse sectional view taken along the line 2—2 of FIG. 1.

Referring now to the drawings in detail, it will be seen that FIGS. 1 and 2 illustrate a portion of an abrasive blasting machine in which a first preferred embodiment of the vane mounting arrangement of this invention is incorporated. The machine is generally identified by the numeral 10 and includes a shaft 12 which has fixedly mounted thereon for rotation therewith a hub 14. The hub 14 has secured thereto by bolts 16 a runnerhead 18.

The apparatus 10 also includes an impeller case 20 which is fixed. The impeller case 20 is spaced from the hub 14 and is provided about the periphery thereof with short lugs 22 to be described hereinafter.

As will be readily apparent from FIG. 1, the face of the runnerhead 18 has formed therein a plurality of slots 24 which may be of a suitable dovetail or other undercut configuration. It is to be noted that the slots 24 are disposed at an angle to a radial line.

It is intended that each slot 24 receive a base 26 of a curved vane 28 with the base 26 being inserted into the slot 24 and removed therefrom from the exterior of the runnerhead. Once the base 26 is inserted in an associated slot, it is retained therein by a retaining pin 30. The specific pin 30 and the mounting thereof in interlocking engagement between the runnerhead 18 and the vane base 26 constitute important features of this invention.

First of all, the pin 30 is of a rectangular cross section as opposed to the customary circular cross section previously used. The pin 30 is provided with a transverse bore 32 into which a suitable removal tool may be engaged to effect the pulling thereof.

At the base of each of the slots 24 and adjacent the outer periphery of the runnerhead 18, as is clearly shown in FIGS. 1 and 2, there is a further well or slot 34 for receiving the pin 30. The slot 34 is rectangular in cross section and of a width greater than that of the pin 30. It will be seen from FIG. 2 that the slot 34 increases in depth from a zero depth at its outer end to a maximum depth at its inner end and that the slot 34 is of a rounded configuration 36 at its inner end. The slot 34 thus may be made by a suitable rotary milling tool.

Figure 8:
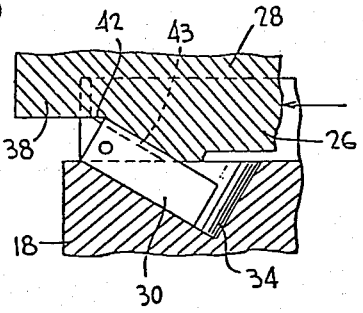
FIG. 8 is a sectional view taken along the line 8—8 of FIG. 7.

At this time it is pointed out that the vane 28 extends radially outward beyond the major portion of the base 26 and that the base 26 has a projection 38 which extends radially outward of the runnerhead 18 when the vane is in its properly seated position, as is clearly shown in FIG. 8.

Figure 3:
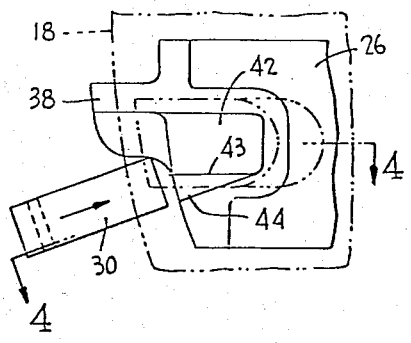
FIG. 3 is an enlarged fragmentary sectional view taken along the line 3—3 of FIG. 2 of the underface of the vane and illustrating the runnerhead and pin slot in phantom lines, and a pin in position for insertion.
Figure 5:
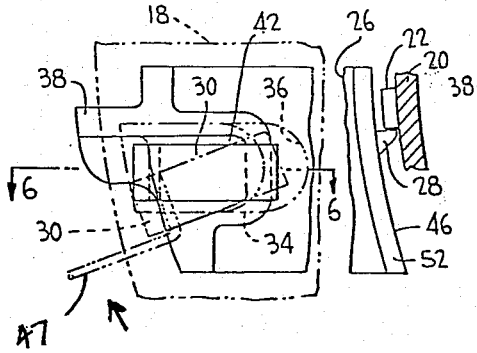
FIG. 5 is an enlarged fragmentary sectional view similar to FIG. 3 but illustrating the pin cammed onto its locking position, there also being illustrated in dot-dash lines the pin and its puller in the position they would assume for withdrawal.
Figure 6:
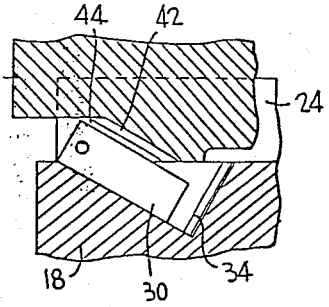
FIG. 6 is a sectional view taken along the line 6—6 of FIG. 5.
Figure 7:
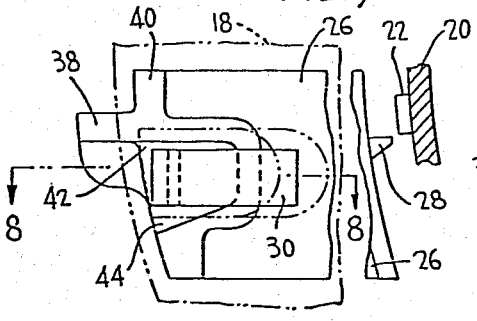
FIG. 7 is another enlarged fragmentary sectional view similar to FIG. 3 but showing the vane withdrawn from contact with the impeller case and in its operative position.

It is also to be noted from FIGS. 3, 5 and 7 that the underside of the base 26 has a generally U-shaped depending support surface 40 at the outer end thereof. Into this supporting surface there are formed two grooves arranged on different levels. The first and deepest of these grooves is identified by the numeral 42 and it is generally centered on the axis of the base 26, as is best shown in FIG. 3. A second groove 44, extends into the base from the outer end thereof at an angle on the order of 30° and is separated from the groove 42 by a shoulder 43. It is to be noted that the grooves 42,44 slope downwardly and inwardly at the same angle as the slot 34. It is further to be noted that the spacing of the upper surface of the groove 42 and the lower surface of the slot 34 correspond generally to the thickness of the pin 30 when the vane 28 is in its operating position, as is shown in FIG. 8, and that when the vane 28 is in its innermost position, as show in FIG. 6, the spacing between the upper surface of the groove 44 and the lower surface of the slot 34 is greater than that of the thickness of the pin 30.

With reference to FIG. 5, in particular, it will be also seen that the base 26 has a curved inner surface 46 which is disposed concentric with the outer surface of the impeller case 20. Further, it will be seen that the inner end of the vane 28 projects radially inwardly beyond the curved surface 46.

Figure 4:
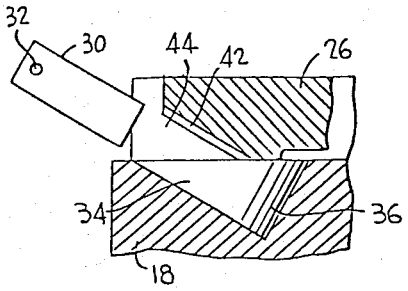
FIG. 4 is a sectional view taken along the line 4—4 of FIG. 3.

Referring now to FIGS. 3 through 8, it will be seen that when a vane 28 is to be installed, the base 26 is slid into its respective slot 24 until the inner end of the vane 28 strikes the outer surface of the impeller case 20. At this time the spacing between the remote surfaces of the groove 44 and the slot 34 permits the insertion of the pin 30, as is shown in FIGS. 3 and 4. When the pin 30 is fully seated, as is shown in phantom lines in FIG. 5, due to the rounded inner end 36 of the slot 34, the pin 30 may be readily rotated in the direction of the arrow in FIG. 5 to its seated full line position. It is now aligned with the groove 42.

As is clearly shown in FIG. 5, the vane 28 must now be withdrawn, otherwise when the runnerhead 18 is rotated, the inner tip of the vane 28 will engage one of the lugs 22. When the vane 28 is withdrawn in an outward radial direction, as shown in FIG. 7, the pin 30 becomes fully seated in the groove 42 and the slot 34 as is clearly illustrated in FIG. 8. The vane 28 is now prevented from moving further radially outward during the operation of the apparatus.

It is also to be noted that the overhand 38, into which the groove 42 merges, functions as a slot to prevent the accidental outward movement of the pin 30 and shoulder 43 prevents sidewise movement after the vane is pulled out into its running position. Thus the pin 30 is firmly locked in place while it firmly locks the vane in place.

When it is desired to replace the vane 28, it is merely necessary to first move the vane radially inward until it engages the impeller case 20, as shown in FIG. 5. Then utilizing a conventional tool 47 and engaging it in the hole 32 and the pin 30, the pin 30 is first rotated out of alignment with the groove 42 into alignment with the groove 44, after which it may be radially withdrawn, thereby freeing the vane 28 for removal.

No other components of the apparatus need be disassembled in order to effect the removal and replacement of the vane.

With reference to FIG. 2, it is also pointed out here that the underside of the base 26 is provided with other support surfaces 48, 50 and 52 which are radially spaced along the length of the base 26. In addition, the underside of the base 26 may be provided with a groove 54 between the support surfaces 48 and 50 and in this groove may be seated a suitable leaf spring 56 which will bear against the runnerhead 18 and cam the base 26 away from the runnerhead 18 so as to seat the base 26 firmly in slot 24.

Referring now to FIGS. 9 through 12, it will be seen that there is illustrated a modified form of retaining pin receiving groove which is generally identified by the numeral 60. The groove 60 is of a two level construction and includes a primary groove portion 62 which tapers from a maximum depth at its outer end to zero depth at its inner end. The primary groove portion 62 includes a generally rectangular inner part 64 and an entrance part 66 which is angularly disposed with respect to the inner part 64.

The groove 60 also includes a secondary portion 68 which is aligned with the primary groove 62. It is to be understood that the secondary groove 68 is relatively narrow and is primarily disposed to one side of the entrance part 66 of the primary groove portion. The secondary groove portion 68 has a top wall which is generally parallel to the support surface 40 and is generally coplanar with the underside of the vane 28. It thus will be seen that the top wall of the secondary groove portion 68 intersects and terminates in the top wall of the primary groove portion 62 into each of the ends of the top wall of the groove portion 62 generally as at 70.

Figure 9:
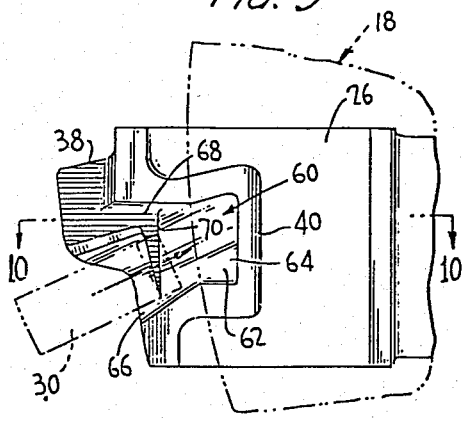
FIG. 9 is a fragmentary plan view of the underface of a vane having a modified pin groove.
Figure 10:
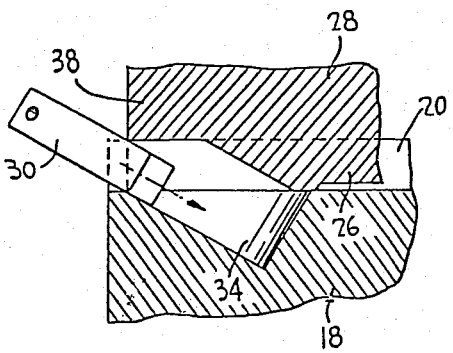
FIG. 10 is a sectional view taken generally along the line 10—10 of FIG. 9 and shows the relationship of the pin groove of the vane with respect to the pin slot of the runnerhead when the vane is in a position for receiving the retaining pin.
Figure 11:
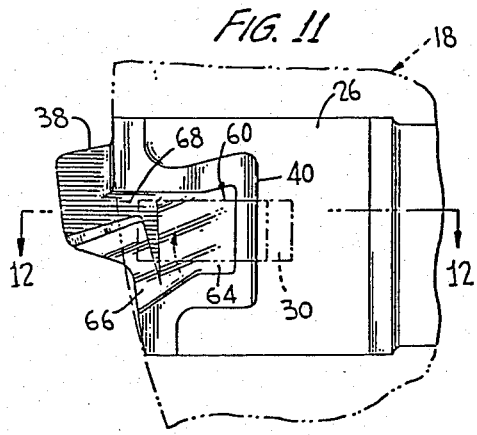
FIG. 11 is a view similar to FIG. 9 showing the retaining pin in place in dotted lines and the vane retracted radially outward relative to the runnerhead.
Figure 12:
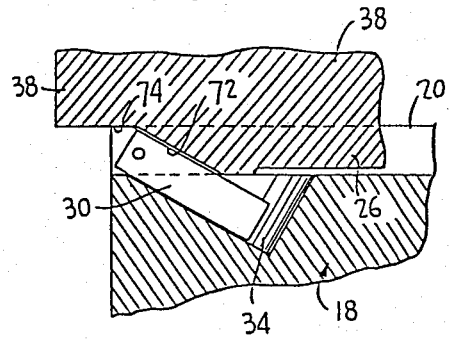
FIG. 12 is a verticle sectional view taken generally along the line 12—12 of FIG. 11 and shows specifically the position of the retaining pin in position locking the vane against radial outward movement.

When the vane is in its innermost position, a locking pin 30 may be freely inserted into the primary groove portion 62 by passing it through the entrance part 66 and down into the slot 34, generally as is shown in FIGS. 9 and 10. When the retaining pin 30 is in its fully inserted position, it is then shifted out of alignment with the entrance part 66 and into alignment with the secondary groove portion 68, as is shown in FIG. 11. The retaining pin 30 is now in a vane retaining position and the vane is pulled outward until the retaining pin 30 is wedged between the sloping top wall 72 of the inner part of the primary groove, portion 62 and the bottom wall of the slot 34, as is shown in FIG. 12. At this time the retaining pin 30 is strapped in position by the top wall of the secondary groove portion 68, which top wall is identified by the reference numeral 74. The vane is thus retained in place until it is again shifted radially inward and the pin 30 twisted into a position aligned with the entrance part 66 for removal. On the other hand, the entrance part 66 provides access to the retaining pin 30 to effect the removal thereof.

Turning now to FIGS. 13 through 21, these figures show various views of a third preferred embodiment of the vane of this invention. This vane is similar to that of FIGS. 9 through 12, except for the shape of certain interior surfaces of the recess.

Figure 13:
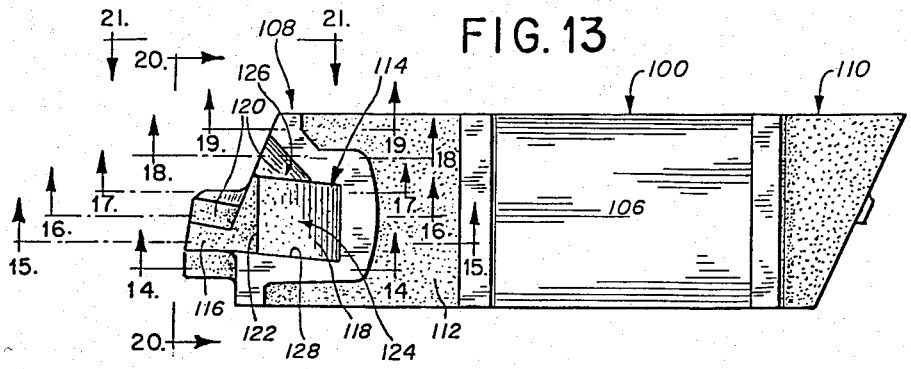
FIG. 13 is a plan view of the underside of a vane which incorporates a third preferred embodiment of this invention.
Figure 14:
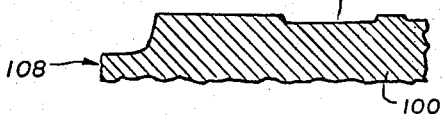
FIGS. 14 through 19 are fragmentary sectional views taken along the respective section lines of FIG. 13.
Figure 15:
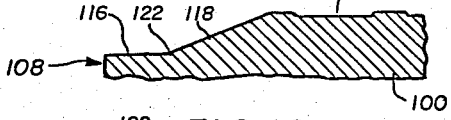
Figure 16:
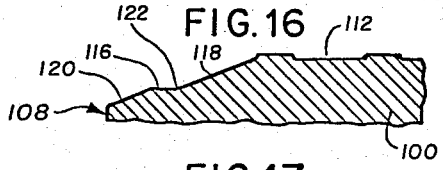
Figure 17:
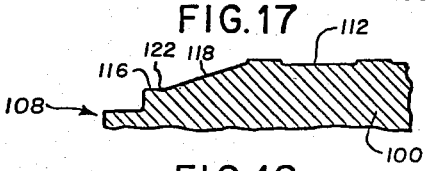
Figure 18:
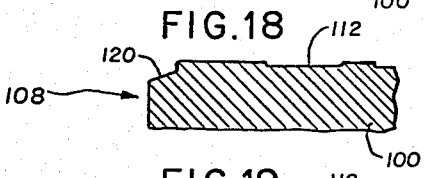
Figure 19:
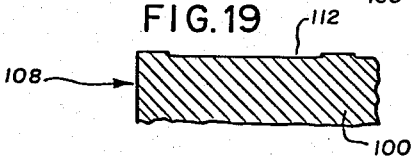
Figure 20:
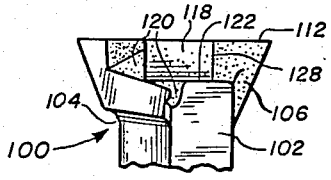
FIG. 20 is a fragmentary end view taken along line 20—20 of FIG. 13.
Figure 21:
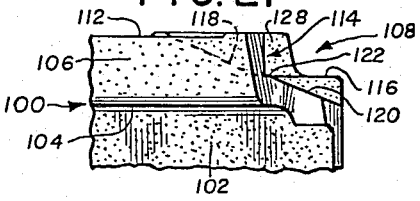
FIG. 21 is a fragmentary side view taken along line 21—21 of FIG. 13.

FIG. 13 shows a vane 100 which comprises a vane blade 102 which is secured to an elongated base 106 at one edge 104 thereof. The base 106 defines first and second ends 108,110. When mounted on a runnerhead such as the runnerhead 18, the first end 108 is positioned radially outward and the second end 110 is positioned radially inward. The surface 112 shown in FIG. 13 of the base 106 is opposed to the vane blade 102.

The opposed surface 112 defines a recess 114 in the first end 108. This recess 114 is a complex shape which can be considered as being formed of two intersecting grooves 124,126. The first groove is a pin retaining groove 124 which is bounded at its inner portions by a planar base surface 116 which intersects a planar ramp surface 118 at a shoulder 122. In this embodiment, the retaining groove 124 is elongated and extends in an axial direction along the length of the base 106. The base surface 116 is oriented parallel to the opposed surface 112 of the base 106, and it extends inwardly from the first end 108. The ramp surface 118 intersects the base surface 116 at an angle of about 150° and is rectangular in shape.

The second groove is a pin insertion groove 126 which is defined at its innermost portion by a planar pin insertion surface 120 which intersects the base surface 116 at an angle of about 30° near the shoulder 122. The pin insertion groove 126 defines an axis which is oriented obliquely to the axis of the pin retaining groove at an angle of about 45° as measured in a plane parallel to the base surface 116.

Figure 22:
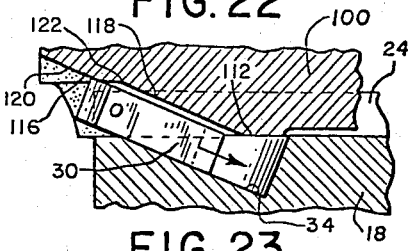
FIG. 22 is a sectional view transverse to the plane of the runnerhead showing the vane of FIGS. 13 through 21 in position for insertion or removal of the retaining pin.
Figure 23:
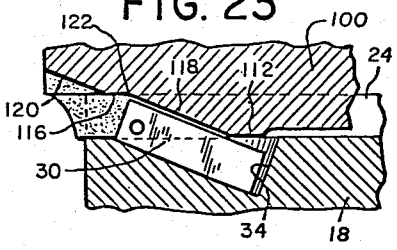
FIG. 23 is a sectional view corresponding to FIG. 22 showing the vane of FIGS. 13 through 21 locked in place on the runnerhead.

In use, the vane of FIGS. 13 through 21 operates in a manner similar to that of FIGS. 9 through 12. That is, the vane base 106 is slideable in a slot 24 in the runnerhead 18 between a radially inward position (as shown in FIG. 22) and a radially outward position (as shown in FIG. 23). When in the radially inward position, a retaining pin such as pin 30 can be placed in the recess 114 via the pin insertion groove 126. A side wall 128 adjacent the ramp surface 118 aids in rotating the pin 30 from an orientation aligned with the pin insertion groove 126 to an orientation aligned with the pin retaining groove 124. As explained above, the rounded lowermost end of the recess or well 34 further aids pin rotation.

Once the pin has rotated into alignment with the axis of the pin retaining groove 124, the vane 100 can be moved to its radially outward position, in which the pin 30 is captured between the recess 34 and the ramp surface 118. The shoulder 122 prevents the pin 30 from moving out of the recess 34. As captured, the pin 30 provides a firm interlock between the vane 100 and the runnerhead 18, preventing further movement of the vane 100 in a radially outward direction.

In order to remove the vane 100 from the runnerhead 18, the vane 100 is first moved to the radially inward position of FIG. 22. The pin 30 is then shifted into alignment with the pin insertion groove 126 and removed via the pin insertion groove 126 from the recess 34. It should be noted that, due to the orientation of the pin insertion groove 126, the vane 100 need be moved inwardly only a small distance to remove the pin 30, thereby allowing removal of the vane 100 from the runnerhead 18 without disassembly of centrally located components of the abrasive blasting machine.

Of course, it should be understood that various changes and modifications can be made to the preferred embodiments described above. For example, in some applications it may be desirable to configure the pin retaining grooves, the pin insertion grooves and the runnerhead wells to accept a pin having a circular cross section rather than a rectangular cross section. Furthermore, specific angles and dimensions of the vane recess and runnerhead well may be modified as necessary in individual applications, and the locking lug feature of the invention can be used with other types of vanes using other means for locking the vanes to the runnerhead.

It is therefore intended that the foregoing detailed description be regarded as illustrative rather than limiting, and that it be understood that it is the following claims, including all equivalents, which define the scope of this invention.

We claim:

1. A throwing vane for a particular throwing device, said vane comprising:

a vane blade:

a base secured to the vane blade, said base having an inner end and outer end spaced along an axial direction and situated such that the vane blade extends between the two ends, said base defining a recess at the outer end thereof, said recess comprising:

a first groove extending generally in the axial direction and bounded at an inner edge by a first surface which extends from a shoulder toward the inner end and is oriented to diverge from the vane blade in the direction of the inner end, and by a second surface which extends from the shoulder to the outer end; and a second groove, intersecting the first groove and oriented obliquely with respect to the axial direction, said second groove bounded at one edge by a third surface having an outer edge positioned to one side of the vane blade and an inner edge intersecting the second surface near the shoulder.

2. The invention of claim 1 wherein the first surface is rectangular in shape.

3. The invention of claim 1 wherein the vane blade defines a base edge and the second surface extends parallel to the base edge of the vane blade.

4. The invention of claim 1 wherein each of the first, second and third surfaces is planar, the angle between the second and third surfaces is about 30° and the angle between the first and second surfaces is about 150°.

5. A throwing vane for a particle throwing device, said device comprising a rotatable plate and at least one retaining pin, said vane comprising:

a vane blade having a first edge;

an elongated base secured to the first edge of the vane blade, said base adapted to be secured to the plate and defining an opposed surface, opposite the vane blade, said opposed surface having a first end and a second end separated in an axial direction;

said base defining a recess in the first end of the opposed surface shaped to receive the retaining pin, said recess comprising a plurality of intersecting grooves comprising:

a first groove bounded on two sides by a base surface and a ramp surface, said base surface oriented substantially parallel to the first edge of the vane blade and said ramp surface inclined with respect to the base surface such that the ramp surface diverges from the vane blade with increasing distance from the first end, said first recess positioned and shaped to retain the retaining pin to secure the base to the plate; and a second groove oriented obliquely with respect to the axial direction and bounded on one side by an insertion surface oriented to intersect the base surface, said second groove positioned and shaped to permit the retaining pin to be removed from the first groove via the second groove while the base is mounted to the plate.

6. The invention of claim 5 wherein the ramp surface is rectangular.

7. The invention of claim 5 wherein the second groove intersects the first groove at an angle of about 45°, as measured in a plane parallel to the base surface.

8. The invention of claim 5 wherein the base surface, the ramp surface and the insertion surface define respective planes wherein the angle between the base surface and the ramp surface is about 150° and the angle between the base surface and the insertion surface is about 30°.

9. A throwing vane for a particle throwing device, said device comprising at least one retaining pin, a rotatable plate defining at least one elongated slot and at least one well, the well situated near the outer edge of the slot and shaped to receive the retaining pin, said vane comprising:

a vane blade having an edge;

an elongated base mounted to the vane blade edge and shaped to engage the elongated slot, such that the base is slideable in the slot, said base defining an opposed face, opposite the vane blade, said opposed face defining an inner end and an outer end spaced along an axial direction, said base defining a recess at the outer end of the opposed face, said recess having a complex shape comprising:

a pin retaining groove aligned with the well when the base is positioned in the slot to capture the pin between the base and the plate to prevent the base from moving outwardly in the slot beyond a predetermined point, said retaining groove bounded on a first side by a ramp surface inclined with respect to the vane blade edge to contact a side of the pin when the base is positioned in the slot and on a second side by a base surface positioned to contact an end of the pin when the base is positioned in the slot; and an insertion groove aligned to intersect the retaining groove, said insertion groove bounded on one side by an oblique surface which intersects the base surface near the region of contact between the base surface and the pin, said insertion groove shaped to permit the pin to be withdrawn from the well and inserted into the well while the base is positioned in the slot with the retaining groove over the well.

10. The invention of claim 9 wherein the ramp surface is rectangular.

11. The invention of claim 9 wherein the base surface is oriented parallel to the vane blade edge.

12. The invention of claim 9 wherein the insertion groove intersects the retaining groove at an angle of about 45°, as measured in a plane parallel to the vane blade edge.

13. The invention of claim 9 wherein each of the ramp surface, base surface and oblique surface defines a respective plane, wherein the angle between the ramp surface and the base surface is about 150° and the angle between the base surface and the oblique surface is about 30°.

* * * * *